US012312551B2

(12) United States Patent
Benson et al.

(10) Patent No.: US 12,312,551 B2
(45) Date of Patent: May 27, 2025

(54) MULTIPHASE COMPOSITE LUBRICANT

(71) Applicant: NEW YORK AIR BRAKE, LLC, Watertown, NY (US)

(72) Inventors: G. Samuel Benson, Jacksonville, FL (US); Michael Stroder, Nixa, MO (US); Craig Shore, Grinnell, IA (US)

(73) Assignee: NEW YORK AIR BRAKE, LLC, Watertown, NY (US)

( * ) Notice: Subject to any disclaimer, the term of this patent is extended or adjusted under 35 U.S.C. 154(b) by 0 days.

(21) Appl. No.: 18/032,586

(22) PCT Filed: Oct. 19, 2021

(86) PCT No.: PCT/US2021/055495
§ 371 (c)(1),
(2) Date: Apr. 19, 2023

(87) PCT Pub. No.: WO2022/086886
PCT Pub. Date: Apr. 28, 2022

(65) Prior Publication Data

US 2024/0093112 A1 Mar. 21, 2024

Related U.S. Application Data

(60) Provisional application No. 63/093,670, filed on Oct. 19, 2020.

(51) Int. Cl.
*C10M 103/02* (2006.01)
*B61K 3/00* (2006.01)
(Continued)

(52) U.S. Cl.
CPC ..... *C10M 103/02* (2013.01); *B61K 3/00* (2013.01); *C10M 103/06* (2013.01);
(Continued)

(58) Field of Classification Search
CPC ..... C10M 103/02; C10M 103/06; C10M 105/34; C10M 105/78; C10M 107/38;
(Continued)

(56) References Cited

U.S. PATENT DOCUMENTS

2007/0010405 A1* 1/2007 Eadie ..... C10M 111/04 524/297
2013/0150270 A1* 6/2013 Abbott ..... C10M 169/04 508/180

FOREIGN PATENT DOCUMENTS

CA 647160 A 8/1962
CA 2074308 A1 2/1993
(Continued)

OTHER PUBLICATIONS

International Search Report and Written Opinion PCT/US2021/055495, filed Oct. 19, 2021. Mailing date of Search Report Oct. 2, 2022. pp. 1-8.
(Continued)

*Primary Examiner* — Taiwo Oladapo
(74) *Attorney, Agent, or Firm* — David L. Nocilly; Bond Schoeneck & King, PLLC

(57) ABSTRACT

A multiphase composite lubricant for a railway lubricant stick that can be used in both low and high temperature applications. The composition of the multiphase composite lubricant includes an amount of a lubricant, an amount of a thermoplastic lattice components that forms a lattice structure, and a polymer extender.

11 Claims, 7 Drawing Sheets

(51) Int. Cl.

| | |
|---|---|
| ***C10M 103/06*** | (2006.01) |
| ***C10M 105/34*** | (2006.01) |
| ***C10M 105/78*** | (2006.01) |
| ***C10M 107/38*** | (2006.01) |
| ***C10M 129/10*** | (2006.01) |
| ***C10M 129/18*** | (2006.01) |
| ***C10M 141/02*** | (2006.01) |
| ***C10M 143/00*** | (2006.01) |
| ***C10M 143/10*** | (2006.01) |
| ***C10M 145/18*** | (2006.01) |
| ***C10M 145/22*** | (2006.01) |
| ***C10M 149/12*** | (2006.01) |
| ***C10M 149/18*** | (2006.01) |
| ***C10M 149/20*** | (2006.01) |
| ***C10M 157/04*** | (2006.01) |
| ***C10M 161/00*** | (2006.01) |
| ***C10M 169/04*** | (2006.01) |
| *C10N 10/04* | (2006.01) |
| *C10N 10/12* | (2006.01) |
| *C10N 20/00* | (2006.01) |
| *C10N 40/00* | (2006.01) |

(52) U.S. Cl.

CPC ..... *C10M 105/34* (2013.01); *C10M 105/78* (2013.01); *C10M 107/38* (2013.01); *C10M 129/10* (2013.01); *C10M 129/18* (2013.01); *C10M 141/02* (2013.01); *C10M 143/00* (2013.01); *C10M 143/10* (2013.01); *C10M 145/18* (2013.01); *C10M 145/22* (2013.01); *C10M 149/12* (2013.01); *C10M 149/18* (2013.01); *C10M 149/20* (2013.01); *C10M 157/04* (2013.01); *C10M 161/00* (2013.01); *C10M 169/044* (2013.01); *C10M 2201/041* (2013.01); *C10M 2201/0613* (2013.01); *C10M 2201/0653* (2013.01); *C10M 2201/0663* (2013.01); *C10M 2205/02* (2013.01); *C10M 2205/04* (2013.01); *C10M 2207/023* (2013.01); *C10M 2207/042* (2013.01); *C10M 2207/28* (2013.01); *C10M 2209/10* (2013.01); *C10M 2209/102* (2013.01); *C10M 2213/0623* (2013.01); *C10M 2217/044* (2013.01); *C10M 2217/045* (2013.01); *C10M 2217/046* (2013.01); *C10N 2010/04* (2013.01); *C10N 2010/12* (2013.01); *C10N 2020/065* (2020.05); *C10N 2020/067* (2020.05); *C10N 2040/00* (2013.01)

(58) Field of Classification Search

CPC ..... C10M 129/10; C10M 129/18; C10M 141/02; C10M 143/00; C10M 143/10; C10M 145/18; C10M 145/22; C10M 149/12; C10M 149/18; C10M 149/20; C10M 157/04; C10M 161/00; C10M 169/044; C10M 2201/041; C10M 2201/0613; C10M 2201/0653; C10M 2201/0663; C10M 2205/02; C10M 2205/04; C10M 2207/023; C10M 2207/042; C10M 2207/28; C10M 2209/10; C10M 2209/102; C10M 2213/0623; C10M 2217/044; C10M 2217/045; C10M 2217/046; B61K 3/00; C10N 2010/04; C10N 2010/12; C10N 2020/065; C10N 2020/067; C10N 2040/00

See application file for complete search history.

(56) References Cited

FOREIGN PATENT DOCUMENTS

| | | | | |
|---|---|---|---|---|
| CA | 2827702 | A1 * | 3/2014 | ..... B61K 3/02 |
| CH | 669207 | A5 | 2/1989 | |
| CN | 106566611 | A | 4/2017 | |
| CN | 112877114 | A | 6/2021 | |
| WO | 03018729 | A1 | 3/2003 | |

OTHER PUBLICATIONS

Translated Chinese Notice of First Examination Action, App. No. 202180071510.6, dated Apr. 11, 2024, pp. 1-14.

* cited by examiner

MULTIPHASE COMPOSITE LUBRICANT

BACKGROUND OF THE INVENTION

1. Field of the Invention

The present invention relates to lubricants and, more specifically, to a lubricant composition for use with railway flanges.

2. Description of the Related Art

It is well understood that wear and friction are a major contributor to noise and costly repairs on sliding surfaces, such as rail flanges. Composite lubricants provide targeted lubrication that can help reduce flange wear and reduce friction and noise. Composite lubricants are formed into sticks that can be biased into contact with the flanges while keeping the tread area clean, thereby avoiding slippage that can caused by other flange lubricants such as grease or oil.

Composite lubricants have been used for many years and ranged from wax-based products to solid lubricant filled composites. Composite lubricants fit primarily into two classes of composites: thermoplastic and thermoset. Thermoplastic lubricants soften or melt when heated, while thermoset resin lubricants remain solid. These two types of composites function very differently. Thermoplastic lubricants respond to increasing friction by softening, so as the heat increases from friction, the thermoplastic lubricants apply more lubricant until the heat is reduced. This creates a self-regulating system that is ideal for some applications. However, in applications that will experience a wider temperature range, the desired variation in hardness can lead to inconsistent lubricant application. Thermoset composite lubricants are less prone to thermal effects as the phase changes have a smaller effect on hardness. Thermoset composite lubricants rely on abrasive wear to transfer lubricant to the surface of the flange and on burnishing to bond the solid lubricants to the surface. This burnishing process functions best in higher speed applications as it allows for better transfer of the lubricant to the surface. The bonds created by solid lubricants, such as molybdenum disulfide, can be adversely affected by contamination on the surface being lubricated, which reduces the efficiency of film creation. FIG. 1 illustrates the response of conventional thermoplastic lubricants and an exemplary thermoset solid lubricant to temperature.

Currently, thermoplastic composites are used for low speed or freight applications and thermosets are used for higher speed or transient rail application. As a result, the same lubricant stick cannot be used throughout all applications. Accordingly, there is a need in the art for an approach that be used in a wide range of temperatures and speeds without adverse results.

BRIEF SUMMARY OF THE INVENTION

The present invention is a multiphase composite lubricant that can be used in both low and high temperature application and thus is particularly suited for use as a railway lubricant stick as well as other applications where a wide range of temperature may be encountered. More specifically, the present invention comprises an amount of a lubricant, an amount of a thermoplastic lattice component that can form a lattice, and an amount of a polymer extender. The combination of a relatively weak thermoset matrix formed by epoxy extended by an acid-crosslinked thermoplastic lattice component and a suspended thermoplastic phase provides the tunable characteristics of the present invention. The synergy between the acidic crosslinking agent and immiscible thermoplastic phase of the composite is responsible for the characteristics of the claimed invention and is particular well suited for lubrication application such as railway lubrication sticks. The lubricant, such as graphite or expanded graphite, may be present in an amount of between 28 and 40 percent by weight. The thermoplastic lattice component, such as soy protein, may be present in an amount between 11 and 60 percent by weight. The polymer extender, such as medium-density polyethylene (MDPE), may be present in an amount between 9.5 and 25 percent by weight. The composition of the multiphase composite lubricant may optionally comprise a cross-linking agent, such as boric acid, of between 9 and 10 percent by weight and an epoxy of between 0.5 and 14 percent by weight.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
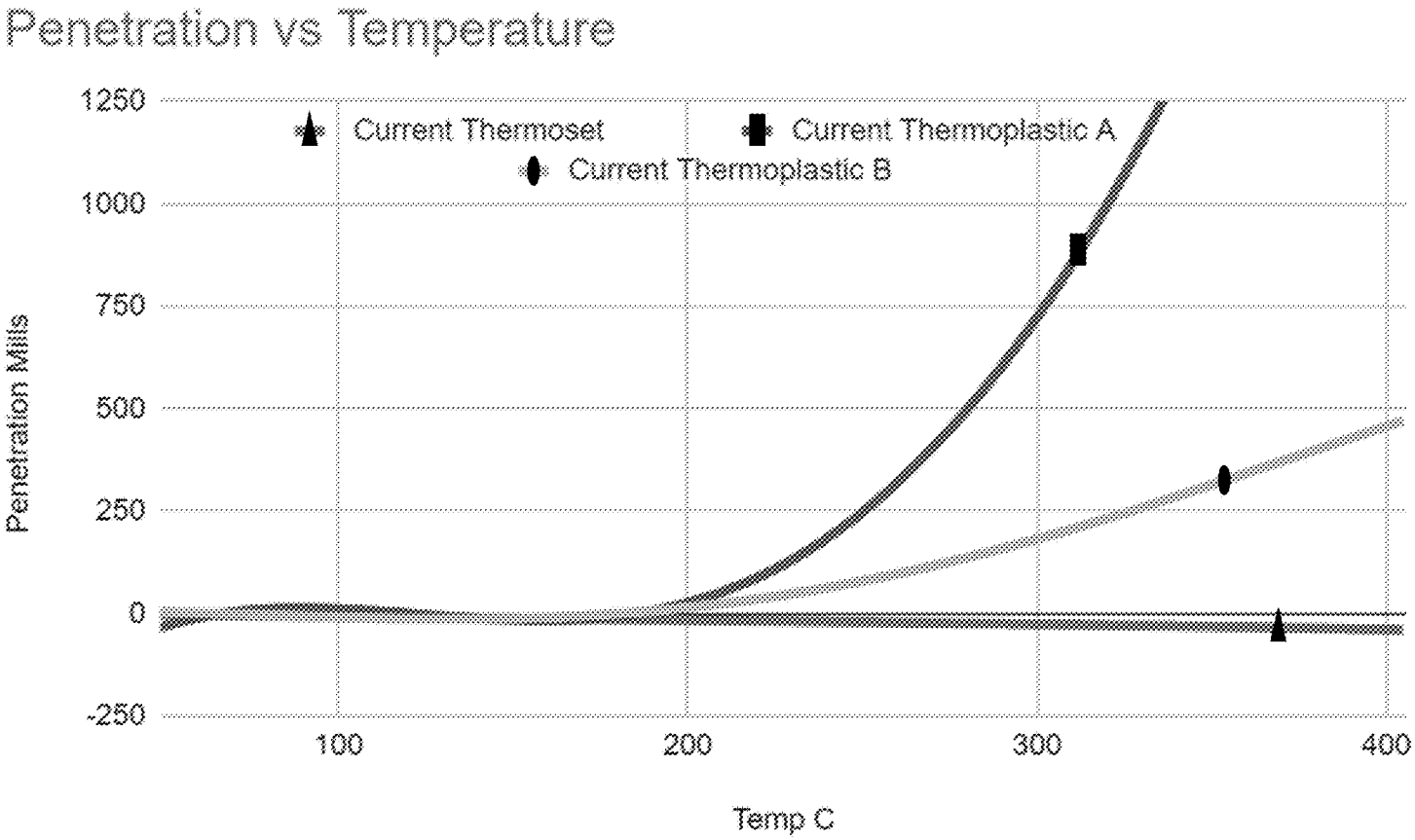
FIG. 1 is a graph of the penetration of conventional lubricants relative to temperature.

Referring to the figures, wherein like numeral refer to like parts throughout, there present invention comprises a multiphase composite lubricant that can be manufactured into a lubrication stick for railway use using a low shear manufacturing process. The composition and low shear manufacturing approach forms a lattice structured composite that can suspend and deliver a variety of lubricants.

More specifically, the composition of the multiphase composite lubricant comprises an amount of a lubricant, an amount of a thermoplastic lattice component that can form a lattice, and an amount of a polymer extender. The combination of a relatively weak thermoset matrix formed by epoxy extended by an acid-crosslinked thermoplastic lattice component and a suspended thermoplastic phase provides the tunable characteristics of the present invention. The synergy between the acidic crosslinking agent and immiscible thermoplastic phase of the composite is responsible for the characteristics of the claimed invention and is particular well suited for lubrication application such as railway lubrication sticks.

The lubricant may be present in an amount of between 28 and 40 percent by weight. The thermoplastic lattice component may be present in an amount between 11 and 60 percent by weight. The polymer extender may be present in an amount between 9.5 and 25 percent by weight. The composition of the multiphase composite lubricant may optionally comprise a cross-linking agent of between 9 and 10 percent by weight and an epoxy of between 0.5 and 14 percent by weight. The lubricant may comprise a solid lubricant such as graphite or expanded graphite. The lubricant may also comprise molybdenum disulfide, zinc stearate, boron nitride, polytetrafluoroethylene (PTFE), tungsten disulfide, boric acid, or combinations thereof. The lubricant may alternatively comprise microparticles containing a liquid lubricant. The thermoset extender lattice component may comprise soy protein or a soy protein containing oil. The thermoset component may also comprise epoxies, polyester, polyurethane, or phenolic. The polymer extender may comprise medium-density polyethylene (MDPE), i.e., polyethylene defined by a density range of 0.926-0.940 g/cm$^3$. A different thermoplastic component may be used as long as the thermoplastic is immiscible with the thermoset matrix. For example, polypropylene, polystyrene, polytetrafluoroethylene (PTFE), polycarbonate, polyester, polyurethane, nylon, and polylactic acid may be used if immiscible with the thermoset that is selected otherwise the lattice structure will not form. The cross-linking agent may comprise boric acid and/or an epoxy. The cross-linking agent may also comprise expanded graphite. Binding additives can also be added to help create lubricant films when solid lubricants are used. The specific characteristics of the composite may be tuned for a particular application by varying the particle size, particle distribution, molecular weight of the polymer components, and amount of cross-linking.

Figure 2:
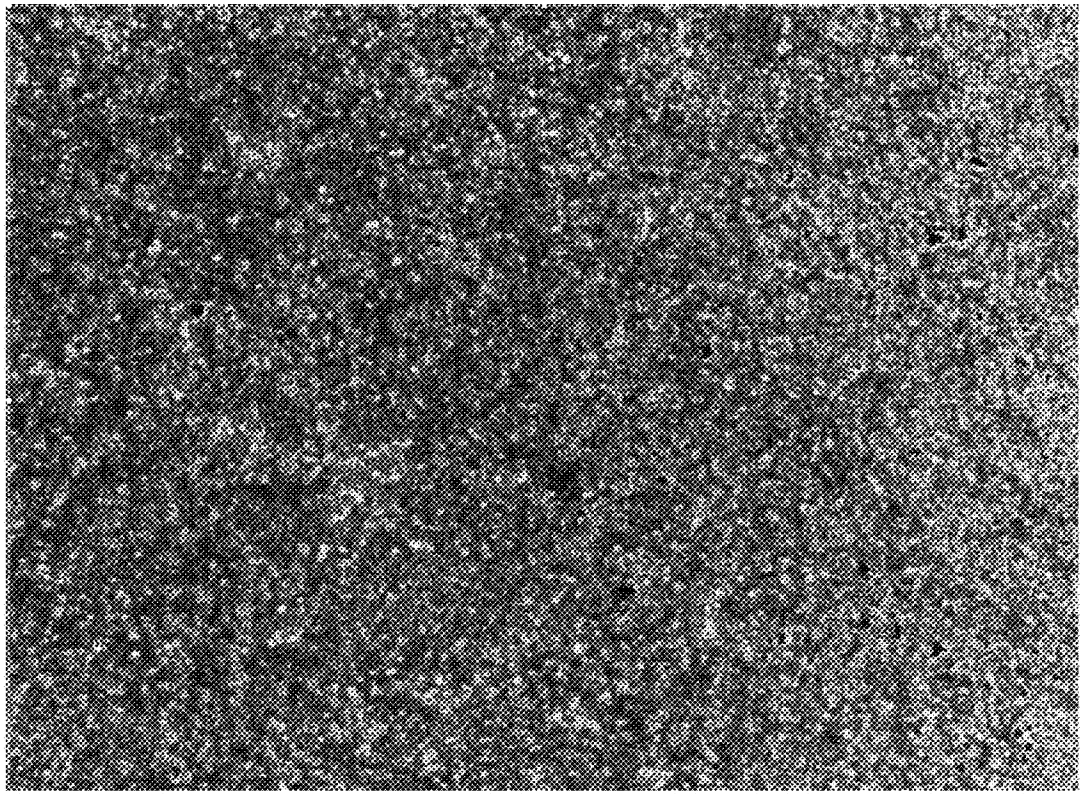
FIG. 2 is an image of a multiphase composite lubricant according to the present invention.

The lubricant that is entrapped within the lattice of the present invention may be tuned for different requirements such as hardness, temperature resistance, stiffness, etc. by adjusting the nature of the compounds that are positioned within the lattice. Referring to FIG. 2, in the example of a composition of graphite, MDPE, and a soy-based thermoset extender containing soy oil filled microparticles (lighter areas) and regions of graphite suspended in a multiphase resin lattice structure (darker areas).

The composition is formed by mixing the components together under high speed and low shear, they are transferred to a mold and are heated to an elevated temperature while pressure is applied and then cooled to room temperature so that the composition solidifies to form the lattice structure containing the solid lubricants or micro encapsulated oil lubricants. The resulting three-dimensional structure entraps the lubricants in suspension within a shape that can be molded for the particular application. For example, the composition may be formed into lubrication sticks for use in railway application by using an appropriately sized mold to form the composition into the desired shape during the heating and cooling steps. In use, the molded composition can be pressed against the face of an object to be lubricated using a spring-loaded applicator. As the composite wears and the lattice degrades, the lubricant is released and delivered to the surface of the object. The transfer rate is controlled by the three-dimensional lattice structure of the composite. As the surface of the molded composition is worn away, micro-sized pockets of lubricant are exposed to provide lubrication with the remaining lubricant held in suspension until needed. The specific composition of the lubrication stick may be varied according to the present invention to tune wear and temperature stability to a desired application, thereby allowing the composition to be used for applications requiring performance characteristics not available with conventional lubrication compositions.

In the present invention, the acid (and/or epoxy) acts as a crosslinking agent for the soy protein and interacts with the polyethylene to act as a softening agent that allows the melt characteristics of a stick to be changed, while leaving the room-temperature hardness constant. Table 1 below provides several exemplary compositions according to the present invention. In Table 1, the primary difference between Examples 46D and 46Dfr is that 46D includes graphite while 46Dfr uses expanded graphite that contains trace amounts of sulfuric acid. Examples 50D and 50Dht are based on the same components with the addition of boric acid and some epoxy to 50Dht.

TABLE 1

| Percent Composition by Weight | | | | | | |
|---|---|---|---|---|---|---|
| Example | Expanded Graphite | Graphite | Soy | MDPE | Boric Acid | Epoxy |
| 40D | — | 30 | 60 | 10 | — | — |
| 46D | — | 30 | 55 | 15 | — | — |
| 46Dht | | 30 | 50 | 9.5 | 10 | 0.5 |
| 46Dfr | 30 | — | 55 | 15 | — | — |
| 48D | — | 30 | 50 | 20 | — | — |
| 50D | — | 25 | 50 | 25 | — | — |
| 50Dht | — | 28 | 45 | 17 | 9 | 1 |

Figure 3:
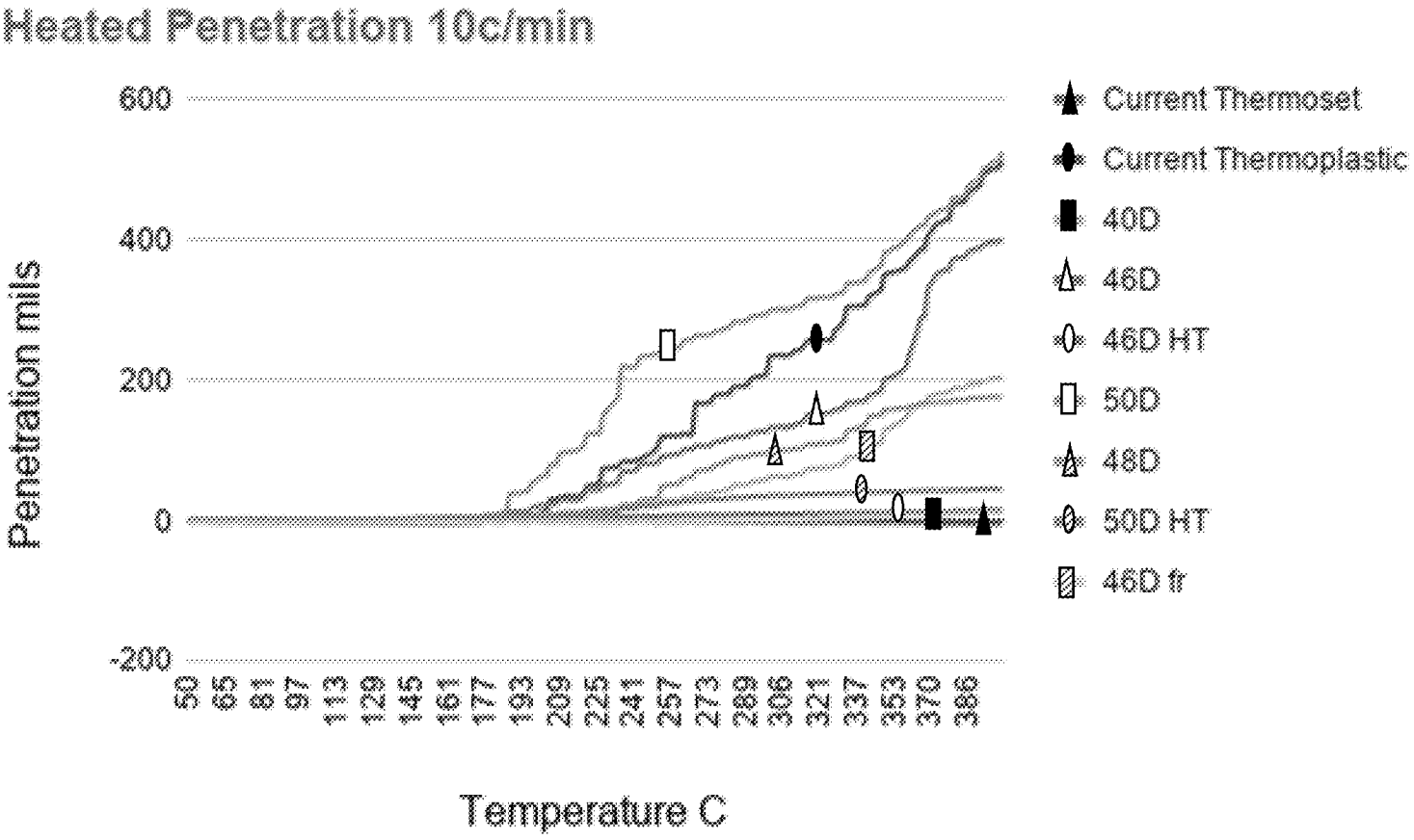
FIG. 3 is a graph of the penetration of various embodiments of the present invention relative as compared to conventional compositions.
Figure 4:
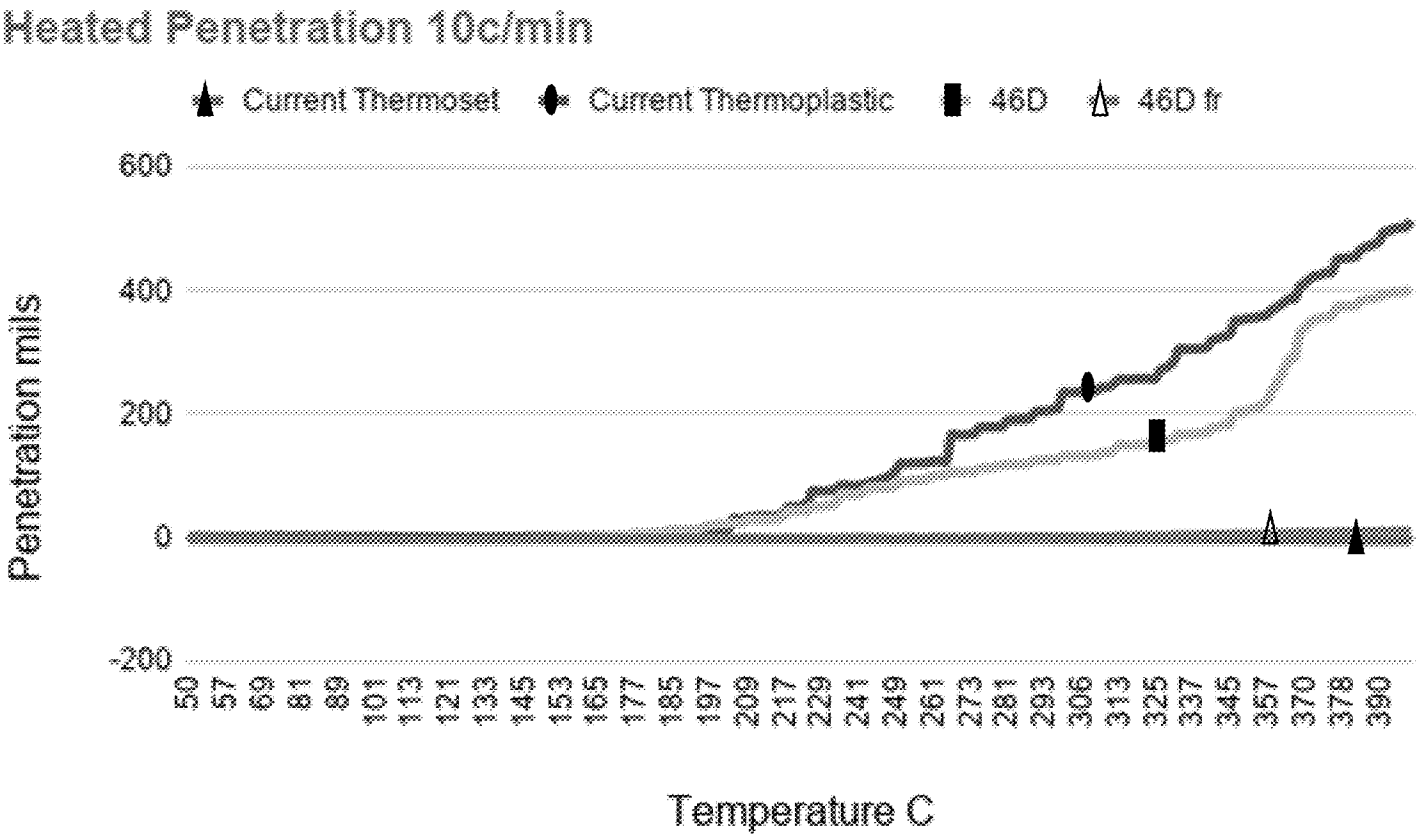
FIG. 4 is a graph of the penetration of certain embodiments of the present invention relative as compared to conventional compositions

Referring to FIGS. 3 and 4, the related compositions share a room-temperature hardness on the Shore scale, but extremely differently under the heated penetration test. In FIG. 4, example 46D is a thermoplastic lattice and example 46Dfr is a thermoplastic/thermoset multiphase lattice composite. As seen in FIGS. 3 and 4, hot probe melts straight through both Example 46D and Example 50D, as would be the case with a conventional thermoplastic lubrication stick. However, sticks made from Example 46Dfr and Example 50Dht maintain a firm overall structure similar to conventional thermoset sticks, albeit with some flexibility imparted when the suspended polyethylene melts. The hardness of exemplary compositions of the present invention versus temperature as compared to conventional thermoplastic and thermoset lubricants illustrates the advantages of the present invention, including the tunability of the composite for specific outcomes.

Figure 5:
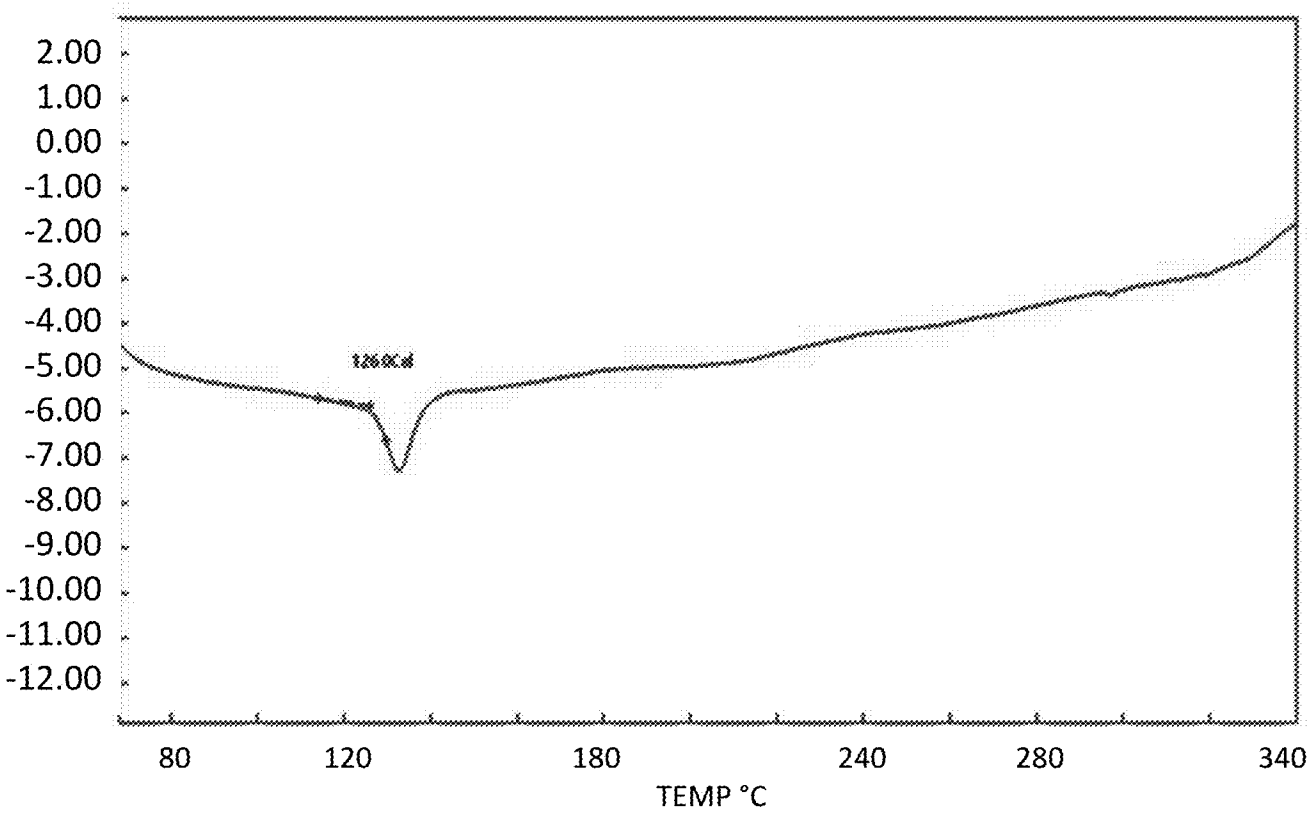
FIG. 5 is a graph of a differential scanning calorimetry test of an embodiment of the present invention.
Figure 6:
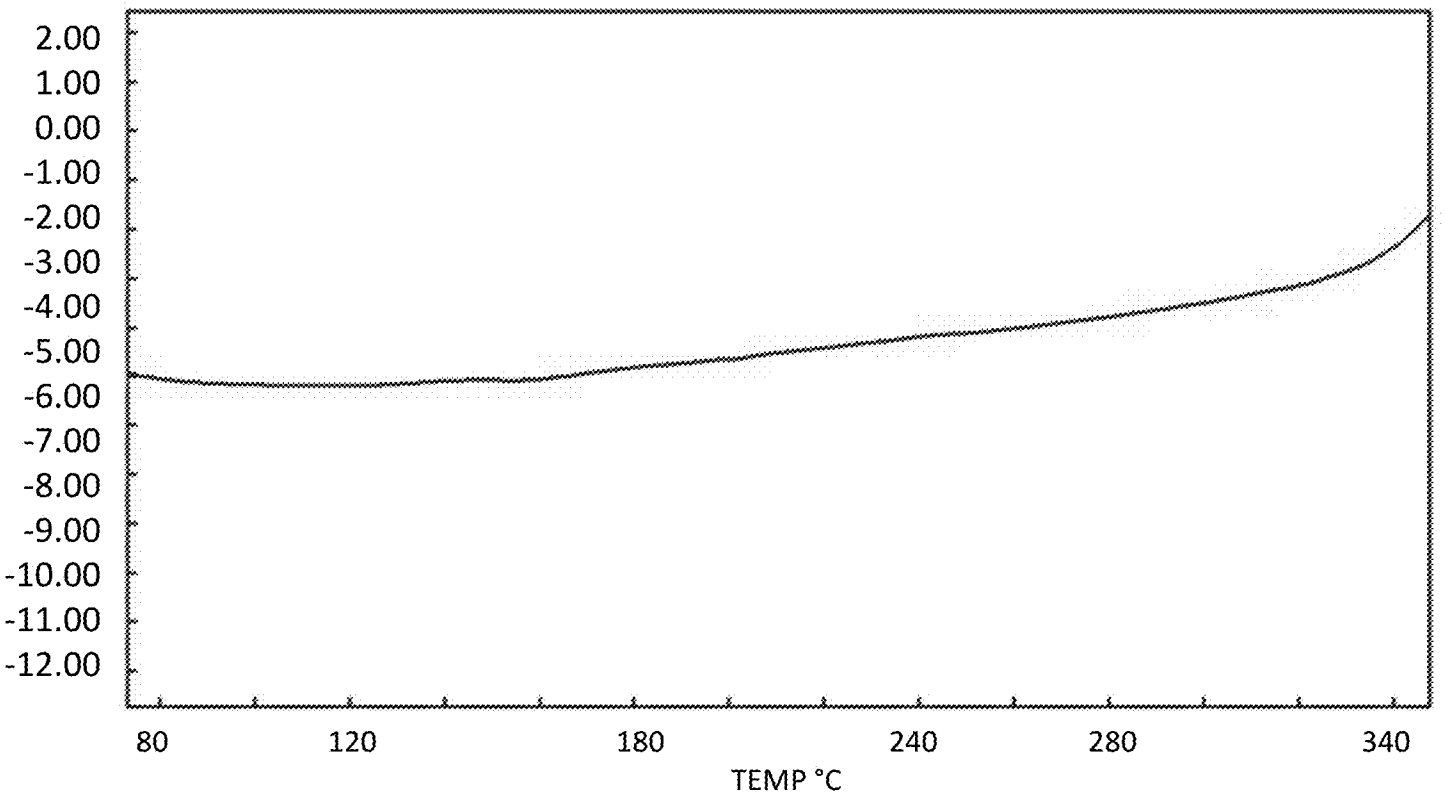
FIG. 6 is a graph of a differential scanning calorimetry test of a conventional thermoset composite lubricant.

Referring to FIG. 5, example 46Dfr has a small thermal event at 126° C. and no other events throughout the test. This event corresponds to the melting temperature of the thermoplastic used to create the thermoplastic lattice. Because the polyethylene is not miscible with the acid-activated soy/epoxy thermoset, the polyethylene does not serve as a simple plasticizer in the thermoset structure. As seen in FIG. 5, the polyethylene phase actually melts into a liquid suspended within a thermoset "sponge" exactly at the typical melting temperature of MDPE and the typical operating temperature of a lubrication stick. This particular melting temperature can be varied by changing the molecular weight of the polyethylene used, or by replacing MDPE with a different thermoplastic as long as the thermoplastic is immiscible with the thermoset matrix. Referring to FIG. 6, an exemplary conventional thermoset composite lubricant closely matches the results of Example 46Dfr seen in FIG. 5, albeit without the event at 126° C.

The lattice of the present invention can be single phase or multiphase where immiscible polymers are used, creating a multiphase lattice where one component can soften at lower temperature while a more temperature-resistant component maintains the overall structure. The thermoset lattice of the present invention can be tuned, such as by including an extender to reduce the level of crosslinking. The extender may be combined with an immiscible thermoplastic to create a multi-phased composite. The thermoplastic can also be used as a binder to create a bonded lubricant film by softening at a lower temperature and transferring to the surface to be lubricated.

Further embodiments of the present invention that were formed into lubrication sticks, as set forth in Table 2 below, were subjected to pin and disk wear testing as compared to baseline compositions.

TABLE 2

| Percent Composition by Weight | | | | | |
|---|---|---|---|---|---|
| Example | Expanded Graphite | Soy | MDPE | Molybdenum Disulfide | Epoxy |
| M10 | 36 | 14 | — | 36 | 14 |
| M4 | 33 | 11 | 11 | 33 | 11 |
| M1 | 40 | | 10 | 40 | 10 |

Example M10 comprises a thermoset and thermoplastic lattice without the extender, Example M4 comprised a thermoset/extender and thermoplastic lattice, and M1 comprised a thermoset/extender according to the present invention.

Figure 7:
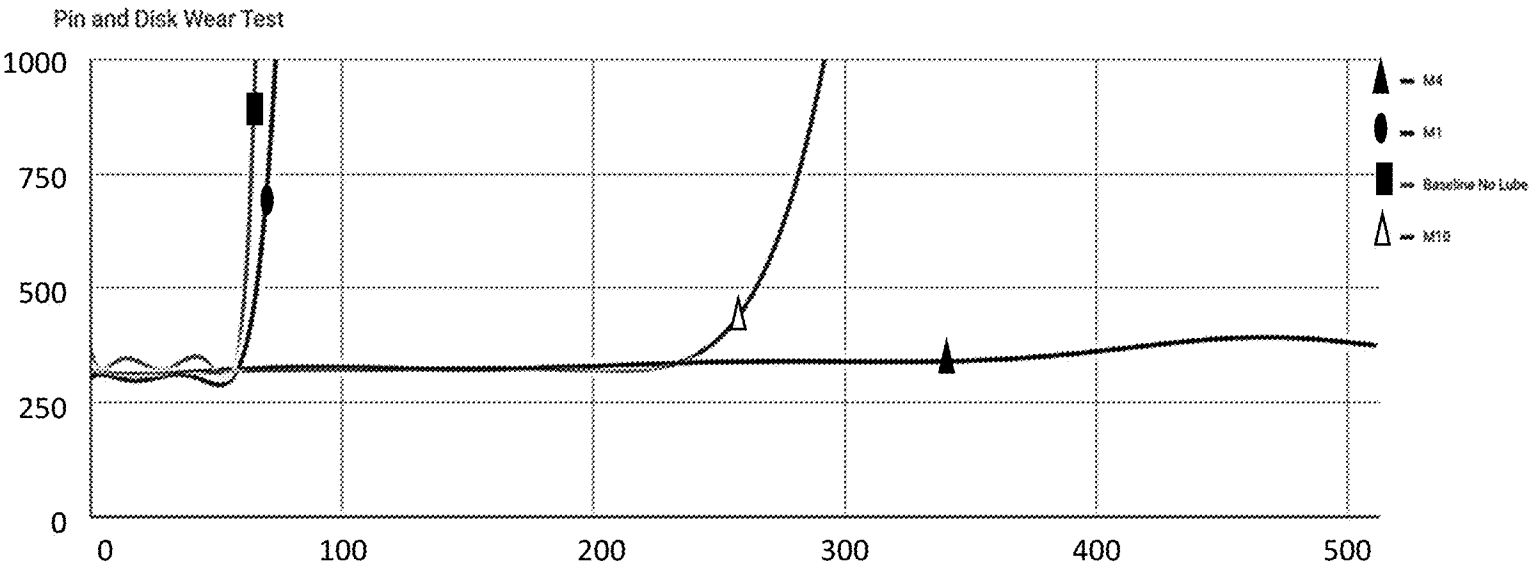
FIG. 7 is a graph of a pin and disk wear test of various embodiments of the present invention.

Referring to FIG. 7, a pin and disk wear test demonstrated the value of both the extender and thermoplastic binder. Example M1 did not form a lubricant film even with a high load of molybdenum disulfide. Example M10 created a much better lubricant film. M4, with both an extended thermoset and thermoplastic lattice, created a film that exceeded the limits of the test. As seen in FIG. 7, the lattice of Example M1 was too strong to release any lubricant and thus performs only little better than an unlubricated comparison. Example M10, which can release lubricant, performed better. The polyethylene of Example M4 was able to soften the stick and allow lubricant to be sheared off the weakened lattice and onto the lubrication surface. The removed liquid polyethylene also serves a second purpose of helping to bind together the graphite/moly into a film on the lubricated surface, adding up to a lubrication performance that ran completely flat past the limits of the test.

What is claimed is:

1. A composition for use as a railway lubrication stick, comprising:

an amount of a lubricant, wherein the lubricant is present in an amount of between 28 and 35 percent by weight, an amount of a thermoplastic lattice component, wherein the thermoplastic lattice component is present in an amount between 45 and 60 percent by weight;

a polymer extender, wherein the polymer extender is present in an amount between 9.5 and 25 percent by weight; and an amount of an epoxy;

wherein the amount of the thermoplastic lattice component and the polymer extender form a lattice that entraps the amount of the lubricant.

2. The composition of claim 1, wherein the epoxy comprises between 0.5 and 1 percent by weight.

3. The composition of claim 2, further comprising an amount of a cross-linking agent.

4. The composition of claim 3, wherein the amount of the cross-linking agent is between 9 and 10 percent by weight.

5. The composition of claim 1, wherein the lubricant is a solid lubricant.

6. The composition of claim 5, wherein the lubricant is selected from the group consisting of graphite, molybdenum disulfide, zinc stearate, boron nitride, polytetrafluoroethylene (PTFE), tungsten disulfide, boric acid, and combinations thereof.

7. The composition of claim 6, wherein the lubricant comprises microparticles containing a liquid lubricant.

8. A composition for use as a railway lubrication stick, comprising:

an amount of a lubricant, an amount of a thermoplastic lattice component, wherein the thermoplastic lattice component includes a soy protein; and a polymer extender;

wherein the amount of the thermoplastic lattice component and the polymer extender form a lattice that entraps the amount of the lubricant.

9. The composition of claim 1, wherein the thermoplastic lattice component is selected from the group consisting of epoxies, polyesters, polyurethanes, and phenolics.

10. The composition of claim 1, wherein the thermoplastic lattice component is selected from the group consisting of polypropylene, polystyrene, polytetrafluoroethylene (PTFE), polycarbonate, polyester, polyurethane, nylon, and polylactic acid.

11. The composition of claim 1, wherein the polymer extender comprises polyethylene having a density range of 0.926-0.940 g/cm3.

* * * * *